US011565898B2

(12) United States Patent
Kimura et al.

(10) Patent No.: US 11,565,898 B2
(45) Date of Patent: Jan. 31, 2023

(54) SHEET ACCOMMODATING APPARATUS, IMAGE FORMING SYSTEM, AND EXTENSION UNIT

(71) Applicant: FUJIFILM Business Innovation Corp., Tokyo (JP)

(72) Inventors: Yoshiki Kimura, Kanagawa (JP); Kiyoshi Watanabe, Kanagawa (JP); Shoichi Maeda, Kanagawa (JP); Masashi Ikeda, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 167 days.

(21) Appl. No.: 16/845,058

(22) Filed: Apr. 9, 2020

(65) Prior Publication Data

US 2021/0061596 A1 Mar. 4, 2021

(30) Foreign Application Priority Data

Sep. 2, 2019 (JP) ..... JP2019-159419

(51) Int. Cl.

| | |
|---|---|
| ***B65H 1/14*** | (2006.01) |
| ***B65H 1/04*** | (2006.01) |
| ***B65H 3/06*** | (2006.01) |
| ***B65H 29/20*** | (2006.01) |
| ***B65H 11/00*** | (2006.01) |

(52) U.S. Cl.

CPC ..... *B65H 3/06* (2013.01); *B65H 11/00* (2013.01); *B65H 29/20* (2013.01); *B65H 2402/443* (2013.01)

(58) Field of Classification Search

CPC .. B65H 1/14; B65H 1/04; B65H 2405/11161; B65H 2405/15; B65H 2405/1116; B65H 2405/1122; B65H 2405/1124; B65H 2405/11164; B65H 2405/111643; B65H 2405/111646; B65H 2701/11312; B65H 2511/11; B65H 3/48; B65H 3/06; B65H 29/20; B65H 2402/443; B65H 11/00

See application file for complete search history.

(56) References Cited

U.S. PATENT DOCUMENTS

| | | | | |
|---|---|---|---|---|
| 6,123,329 | A * | 9/2000 | Sato | B65H 1/14 271/145 |
| 8,628,075 | B2 * | 1/2014 | De La Hamayde | B65H 1/14 271/30.1 |
| 9,359,157 | B2 | 6/2016 | Niikura et al. | |
| 10,549,936 | B2 * | 2/2020 | Shimura | B65H 1/28 |
| 2016/0122141 | A1 * | 5/2016 | Tomaru | B65H 1/24 271/126 |
| 2017/0203930 | A1 * | 7/2017 | Yamauchi | G03G 21/1633 |
| 2021/0061592 | A1 * | 3/2021 | Ikeda | B65H 1/04 |
| 2021/0061594 | A1 * | 3/2021 | Kimura | B65H 1/20 |

FOREIGN PATENT DOCUMENTS

| | | | |
|---|---|---|---|
| JP | 2000318845 | A * | 11/2000 |
| JP | 2013103777 | A * | 5/2013 |
| JP | 2016000653 | | 1/2016 |

* cited by examiner

*Primary Examiner* — Luis A Gonzalez
(74) *Attorney, Agent, or Firm* — JCIPRNET

(57) ABSTRACT

A sheet accommodating apparatus includes a main body portion, a loading portion that is provided in the main body portion and supports a portion of a sheet loaded thereon from below, a lifting unit that lifts the loading portion, and a supporting portion that is connected to the main body portion and supports another portion of the sheet from below during a process in which the loading portion is lifted.

18 Claims, 15 Drawing Sheets

SHEET ACCOMMODATING APPARATUS, IMAGE FORMING SYSTEM, AND EXTENSION UNIT

CROSS-REFERENCE TO RELATED APPLICATIONS

This application is based on and claims priority under 35 USC 119 from Japanese Patent Application No. 2019-159419 filed Sep. 2, 2019.

BACKGROUND

(i) Technical Field

The present invention relates to a sheet accommodating apparatus, an image forming system, and an extension unit.

(ii) Related Art

JP2016-000653A discloses a paper feeding device that is provided with a long-length option such that a tray bottom plate of a paper feeding tray is extended and a long-length sheet is installed. The paper feeding device is provided with a mechanism that locks the paper feeding tray such that the paper feeding tray becomes not able to be drawn out at the time of attachment of the long-length option.

SUMMARY

Aspects of non-limiting embodiments of the present disclosure relate to a sheet accommodating apparatus with which a load on a lifting unit can be reduced in comparison with a configuration in which the entire mass of a sheet is applied to a loading portion.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a sheet accommodating apparatus including a main body portion, a loading portion that is provided in the main body portion and supports a portion of a sheet loaded thereon from below, a lifting unit that lifts the loading portion, and a supporting portion that is connected to the main body portion and supports another portion of the sheet from below during a process in which the loading portion is lifted.

BRIEF DESCRIPTION OF THE DRAWINGS

Exemplary embodiment(s) of the present invention will be described in detail based on the following figures, wherein.

DETAILED DESCRIPTION

Figure 1:
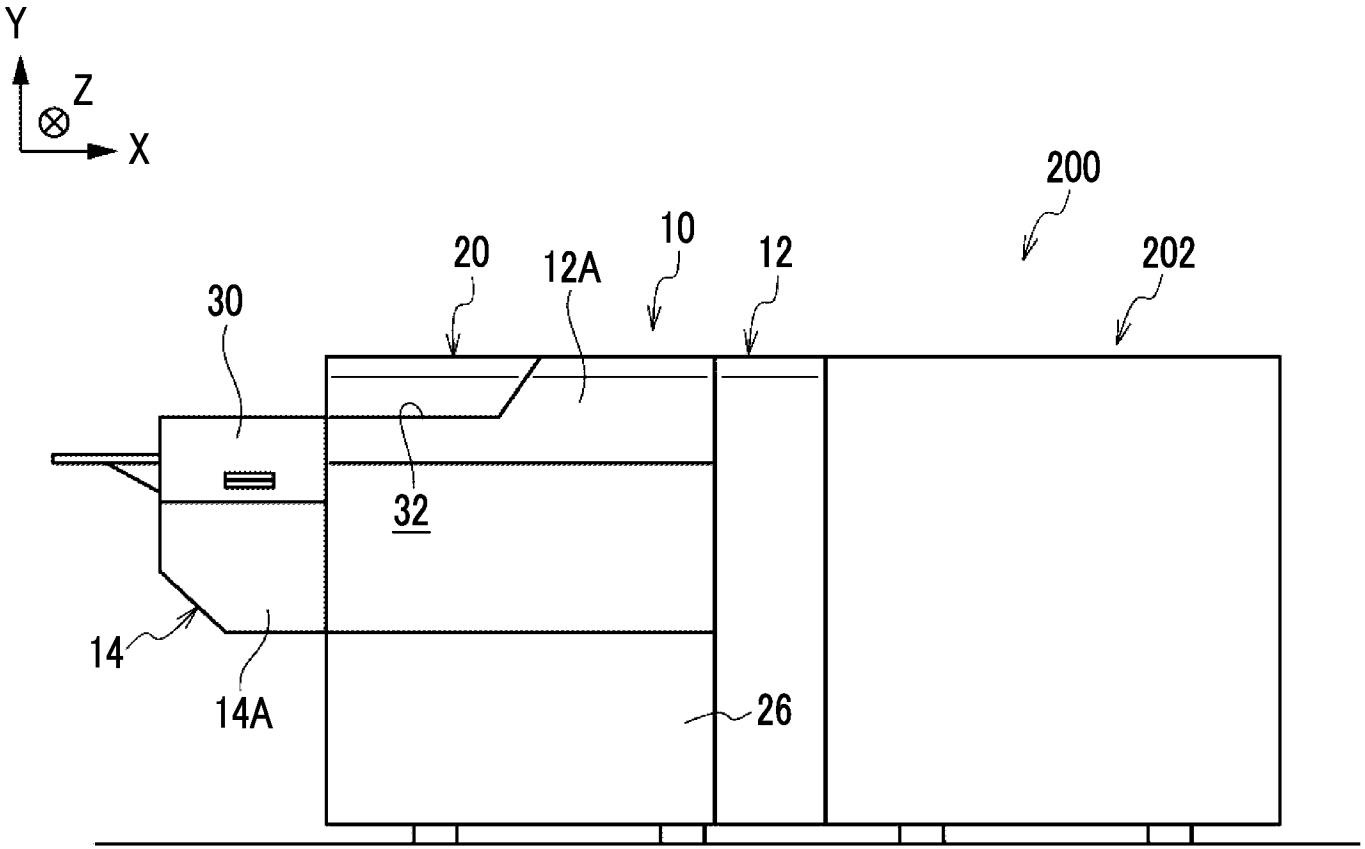
FIG. 1 is a front view showing an image forming system including a sheet accommodating apparatus according to a first exemplary embodiment.

Hereinafter, an exemplary embodiment of the present invention will be described. In the following description, a direction denoted by an arrow X in the drawing will be referred to as an apparatus width direction and a direction denoted by an arrow Y will be referred to as an apparatus height direction. In addition, a direction (direction along arrow Z) orthogonal to the apparatus width direction and the apparatus height direction will be referred to as an apparatus depth direction.

Configuration of Image Forming System

FIG. 1 shows a front view of an example of an image forming system 200 including a sheet accommodating apparatus 10 according to a first exemplary embodiment.

As shown in FIG. 1, the image forming system 200 includes an image forming apparatus 202 that forms an image on a recording medium which is an example of a sheet and the sheet accommodating apparatus 10 that supplies the recording medium to the image forming apparatus 202. The sheet accommodating apparatus 10 is disposed to be adjacent to a side portion of the image forming apparatus 202. Although not shown, in the image forming apparatus 202, an image forming unit that forms an image on a recording medium and a transporter that transports the recording medium to the image forming unit are provided. Note that, various methods can be adopted as a recording method for the image forming unit. For example, an inkjet recording method, an electrophotographic recording method, a letterpress printing method, a lithographic printing method, an intaglio printing method, and the like can be adopted. The configurations and the arrangement of the image forming unit and the transporter are not particularly limited. The sheet accommodating apparatus 10 is attached to the image forming apparatus 202 as an option and is handled alone.

Configuration of Sheet Accommodating Apparatus Overall Configuration

Figure 2:
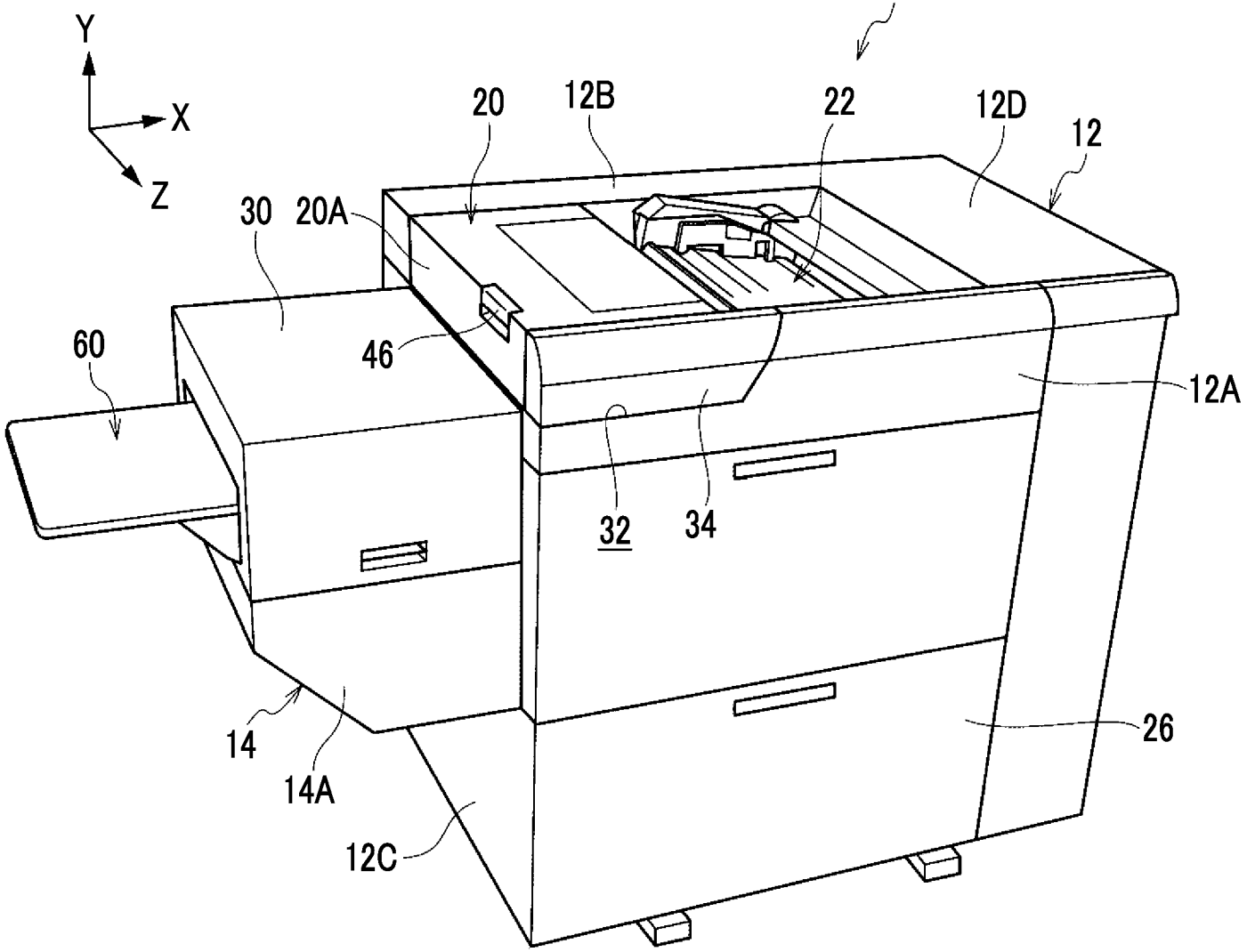
FIG. 2 is a perspective view showing the sheet accommodating apparatus according to the first exemplary embodiment.

FIG. 2 shows a perspective view of the sheet accommodating apparatus 10 according to the first exemplary embodiment. As shown in FIG. 2, the sheet accommodating apparatus 10 includes a main body portion 12 as an apparatus main body and an attachment device 14 that is attached such that the attachment device 14 projects toward the outside of the main body portion 12 from a side portion of the main body portion 12. The attachment device 14 is configured to be additionally attached to the main body portion 12 as an option.

Figure 3:
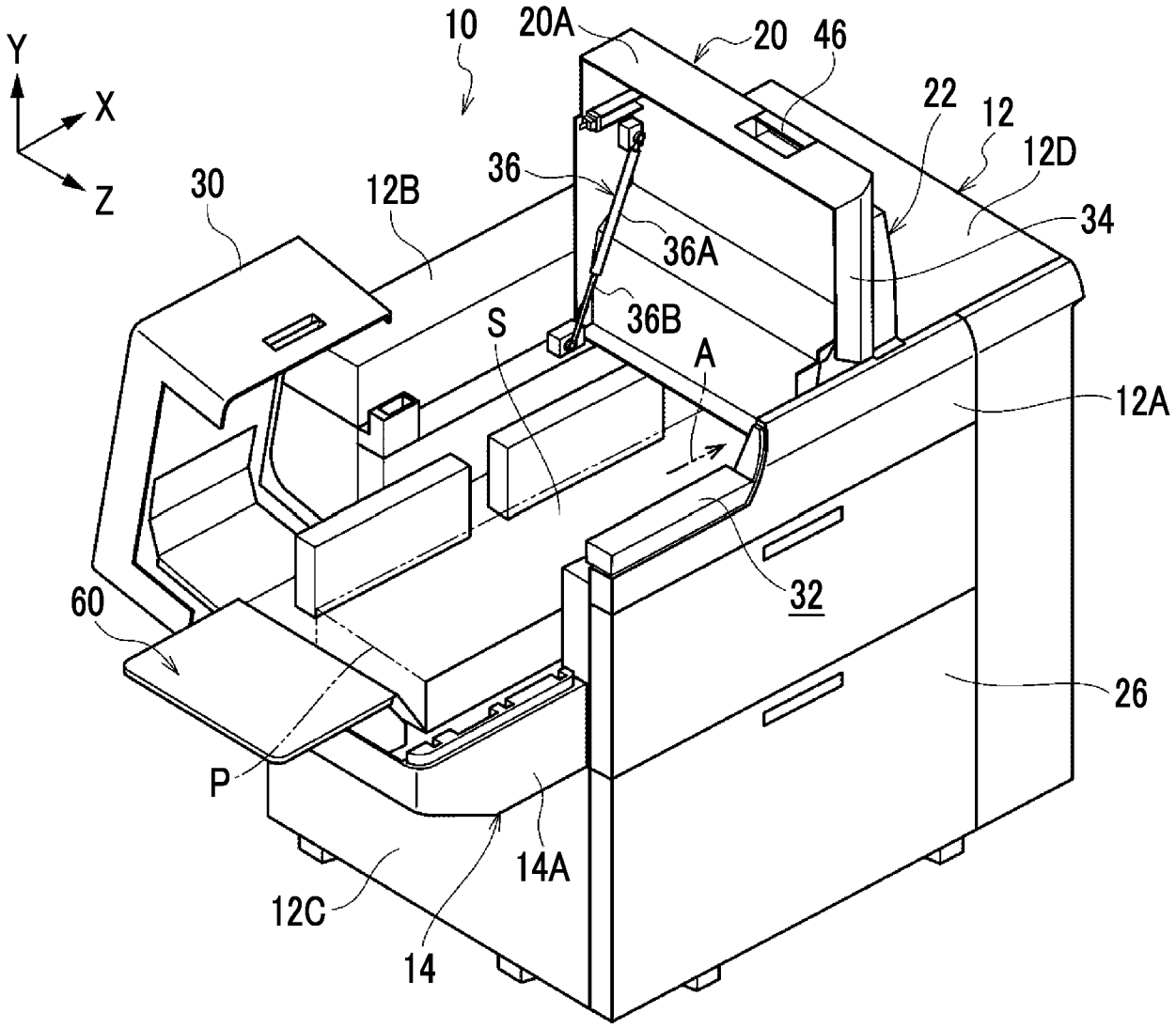
FIG. 3 is a perspective view showing a state where an opening and closing member and a rotary member used in the sheet accommodating apparatus according to the first exemplary embodiment are rotated such that a loading space on a loading portion is opened.
Figure 4:
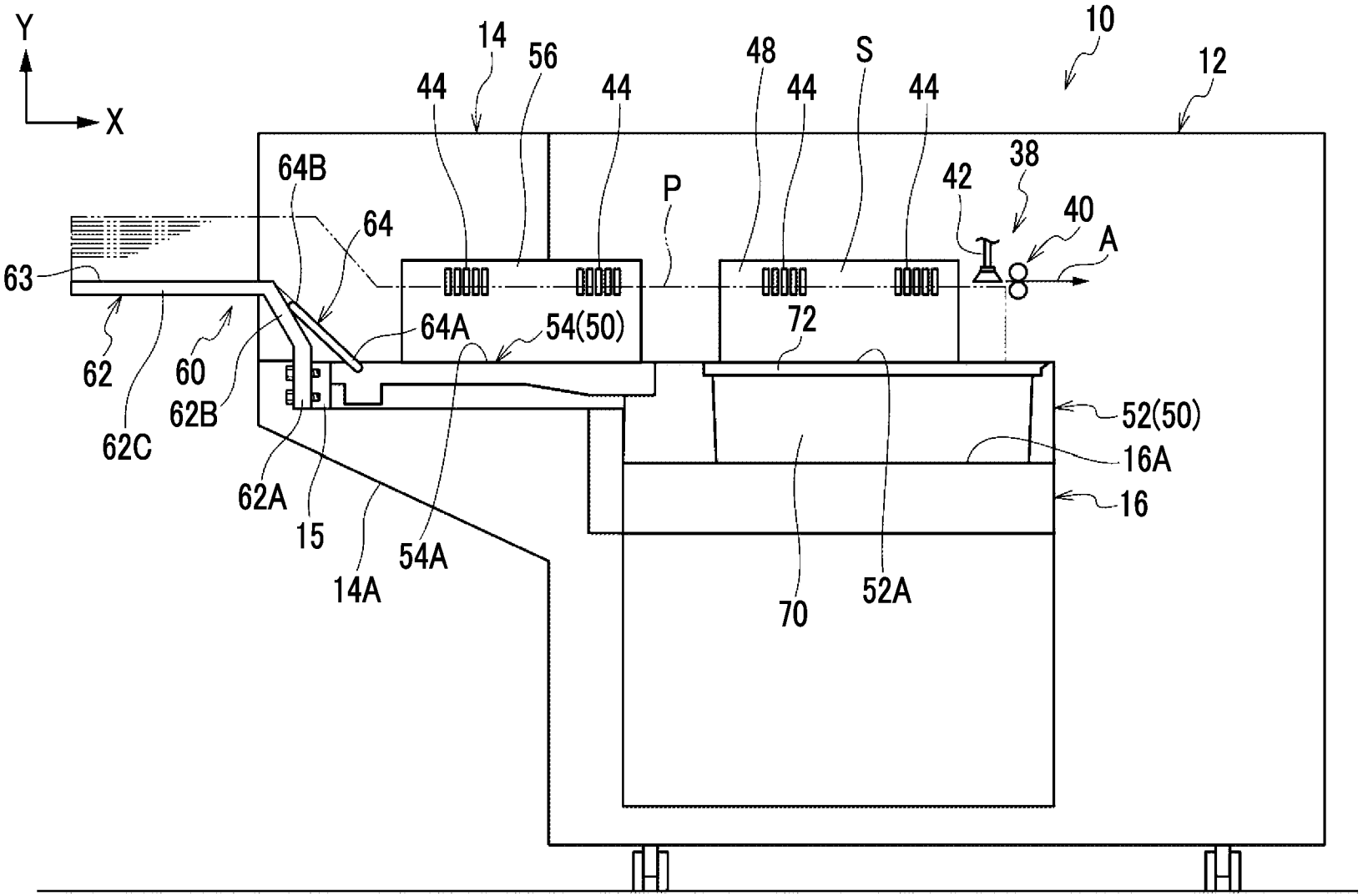
FIG. 4 is a sectional view showing an extension device of the sheet accommodating apparatus according to the first exemplary embodiment and a second extension unit attached to the extension device.

As shown in FIGS. 3 and 4, in the main body portion 12, a loading space S is provided above a loading portion 16 (refer to FIG. 4) onto which a plurality of recording mediums P are loaded. In a case where the attachment device 14 is attached to the side portion of the main body portion 12, the recording medium P having a long length, of which the length in a longitudinal direction is longer than the length of the recording medium P that is loaded onto the loading portion 16 in a case where only the main body portion 12 is provided, becomes able to be accommodated. The attachment device 14 includes a first extension unit 50, which is an example of an extension loading portion onto which the recording medium P having along length is loaded (refer to FIG. 4). In addition, a second extension unit 60, which is an example of a supporting portion that extends the first extension unit 50, is attached to the attachment device 14 (refer to FIG. 4). The second extension unit 60 is configured to be attached to the attachment device 14 as an option.

As shown in FIGS. 2 and 3, the sheet accommodating apparatus 10 includes an opening and closing member 20 that is provided at an upper portion of the main body portion 12 and opens and closes the loading space S in which the recording medium P is loaded and a damper 36 that assists an operation of opening the loading space S performed by the opening and closing member 20 (refer to FIG. 3). In addition, the sheet accommodating apparatus 10 includes a rotary member 22 that is disposed such that the opening and closing member 20 is overlaid with the rotary member 22. The rotary member 22 can rotate with respect to the main body portion 12 in accordance with the opening and closing of the opening and closing member 20. On an upper portion of the rotary member 22, a recording medium (not shown) for manual feeding is disposed. Ona portion of the attachment device 14 that projects from the side portion of the main body portion 12, an opening and closing cover 30 (which will be described later) that opens and closes the loading space S in which the recording medium P having a long length is loaded is provided.

Furthermore, the sheet accommodating apparatus 10 includes a drawer tray 26 in which a different kind of recording medium (not shown) from the recording medium P is stored, the drawer tray 26 being disposed at a lower portion on a front side in the depth direction (that is, direction Z) of the main body portion 12. The drawer tray 26 is drawn from the main body portion 12 to store a different kind of recording medium (not shown) from the recording medium P.

Main Body Portion

As shown in FIGS. 2 and 3, the main body portion 12 has a function as a housing for parts of the sheet accommodating apparatus 10 other than the attachment device 14. The main body portion 12 includes a front wall 12A that is disposed on a front side in the apparatus depth direction (that is, direction Z) and a rear wall 12B that is disposed on a rear side in the apparatus depth direction. In addition, the main body portion 12 includes a side wall 12C that is disposed on one side in the apparatus width direction (that is, direction X) and a side wall (not shown in FIG. 2) that is disposed on the other side in the apparatus width direction. The front wall 12A is composed of a plurality of panels. The drawer tray 26 is provided in an area excluding an upper portion side of the front wall 12A and a portion of the front wall 12A that is on the other side in the apparatus width direction.

In addition, the main body portion 12 includes an upper wall 12D that is disposed above the front wall 12A, the rear wall 12B, the side wall 12C, and the other side wall (not shown in FIG. 2). The upper wall 12D is disposed only on the other side in the apparatus width direction. Upper ends of the front wall 12A and the rear wall 12B are connected to the upper wall 12D and a portion of the loading space S is covered by the upper wall 12D.

The front wall 12A and the rear wall 12B are configured such that the loading space S for the recording medium P is interposed between the front wall 12A and the rear wall 12B on opposite sides in a direction intersecting a transportation direction of the recording medium P, that is, the apparatus depth direction denoted by the arrow Z. In addition, the front wall 12A is provided with a cutout portion 32 obtained by making the height of a portion of the front wall 12A that is on a side opposite to the upper wall 12D c than the height of a portion of the front wall 12A that is connected to the upper wall 12D.

As shown in FIG. 4, the main body portion 12 includes the loading portion 16 onto which the recording medium P is loaded is provided. Although not shown, in a case where the attachment device 14 is not attached to the main body portion 12, the recording medium P having a normal size is directly loaded onto the loading portion 16 in the main body portion 12. As the recording medium P having a normal size, for example, the recording medium P having a length in a longitudinal direction up to 488 mm is used. A recording medium having a size of A3 or below corresponds to an example of the recording medium P having such a size.

The main body portion 12 is provided with a lifting and lowering device 100 (refer to FIG. 14) that lifts and lowers the loading portion 16 in a vertical direction. The lifting and lowering device 100 is configured to lift the loading portion 16 such that the position of the uppermost recording medium P from among the recording mediums P loaded onto the loading portion 16 reaches a predetermined height. Here, the lifting and lowering device 100 is an example of a lifting unit. The configuration of the lifting and lowering device 100 will be described later.

In the main body portion 12, a transportation unit 38 that is disposed on the upper wall 12D side and transports the recording mediums P loaded onto the loading portion 16 one by one is provided. The transportation unit 38 includes a paper feeding roller 40 that feeds the uppermost recording medium P on the loading portion 16 and a suction unit 42 that is disposed inward of the paper feeding roller 40 in the apparatus width direction and sucks the uppermost recording medium P. Furthermore, the transportation unit 38 includes a plurality of air blowing units 44 disposed on a side wall 48 inside the main body portion 12. The plurality of air blowing units 44 are disposed to face upper portions of a plurality of the recording mediums P loaded onto the loading portion 16 and are configured to blow air to a space between the plurality of recording mediums P.

The paper feeding roller 40 is composed of a pair of rollers and feeds the recording medium P to the image forming apparatus 202 (refer to FIG. 1) side, that is, in a direction along an arrow A. The suction unit 42 is supported such that the suction unit 42 can move along the transportation direction of the recording medium P and supplies the recording medium P to a contact portion of the paper feeding roller 40 by moving to a downstream side in the transportation direction of the recording medium P with the recording medium P sucked thereto. The air blowing units 44 blow air to a space between a plurality of the recording mediums P such that the recording mediums P are restrained from being multi-fed by the paper feeding roller 40.

Opening and Closing Member

The opening and closing member 20 opens the loading space S for the recording medium P together with the opening and closing cover 30 in order that a plurality of the recording mediums P are disposed on the loading portion 16. As shown in FIGS. 2 and 3, the opening and closing member 20 is provided between an upper portion of the front wall 12A and an upper portion of the rear wall 12B. In the present exemplary embodiment, the opening and closing member 20 is provided at a position adjacent to the upper wall 12D of the main body portion 12.

The opening and closing member 20 is configured to open and close the loading space S (refer to FIG. 3) for the recording medium P by rotating around a hinge (not shown) provided on a downstream side in the transportation direction (that is, direction along arrow A shown in FIG. 3) of the recording medium P. The hinge is provided on an edge side of the upper wall 12D (refer to FIG. 2), which corresponds to one end side of the front wall 12A and one end side of the rear wall 12B in the apparatus width direction. The opening and closing member 20 covers an area from the upper wall 12D to end portions of the front wall 12A and the rear wall 12B on an upstream side in the transportation direction (that is, direction along arrow A shown in FIG. 3) of the recording medium P in a state where the loading space S is closed.

The opening and closing member 20 is provided with a projecting portion 34 that projects from an edge portion of the opening and closing member 20 and fills a gap between the cutout portion 32 and the edge portion of the opening and closing member 20 in a state where the loading space S is closed (refer to FIG. 2). The projecting portion 34 is provided on a tip end portion 20A side of the opening and closing member 20.

The damper 36 includes a tubular damper main body 36A and a rod 36B that is provided to be able to move forward and backward from the damper main body 36A. An end portion of the damper main body 36A that is on a side opposite to the rod 36B is rotatably supported by the opening and closing member 20. A tip end portion (that is, end portion on side opposite to damper main body 36A) of the rod 36B is rotatably supported by the rear wall 12B. The damper 36 is configured such that the rod 36B is pressed in a direction in which the rod 36B moves forward with respect to the damper main body 36A and in a case where the opening and closing member 20 is lifted halfway in a direction in which the loading space S is opened, the opening and closing member 20 is lifted up due to the action of the damper 36.

As shown in FIG. 2, the tip end portion 20A of the opening and closing member 20 is provided with a handle 46 used to release the opening and closing member 20 locked at the main body portion 12 in a state where the loading space S is closed by the opening and closing member 20. The handle 46 is configured to rotate in, for example, the vertical direction and is configured such that the opening and closing member 20 locked at the main body portion 12 by means of a latch mechanism (not shown) is released and the opening and closing member 20 becomes able to rotate in a direction in which the loading space S is opened in a case where the handle 46 is lifted up.

Attachment Device

The attachment device 14 has a function of accommodating the recording medium P having a long length, of which the length in the longitudinal direction is longer than the length of a recording medium of a normal size, while being attached to the side portion of the main body portion 12. As shown in FIGS. 2 and 3, the attachment device 14 projects to the outside of the main body portion 12 from an upper side of the side wall 12C of the main body portion 12. In the present exemplary embodiment, the attachment device 14 is disposed to be laid across a space between the front wall 12A and the rear wall 12B and a position outward of the side wall 12C. The attachment device 14 includes a main body portion 14A, which is a housing attached to the side wall 12C of the main body portion 12, and the opening and closing cover 30 provided on the main body portion 14A.

The opening and closing cover 30 is configured to rotate along the apparatus depth direction via a hinge (not shown) provided on a rear side of the main body portion 14A in the apparatus depth direction (that is, direction Z) (refer to FIG. 3). In a case where the opening and closing cover 30 is upwardly rotated toward the rear side from the front side in the apparatus depth direction (direction Z), a portion of the loading space S for the recording medium P having a long length is opened. In addition, the opening and closing cover 30 covers a portion of the attachment device 14 that projects from the front wall 12A and the rear wall 12B.

Figure 5:
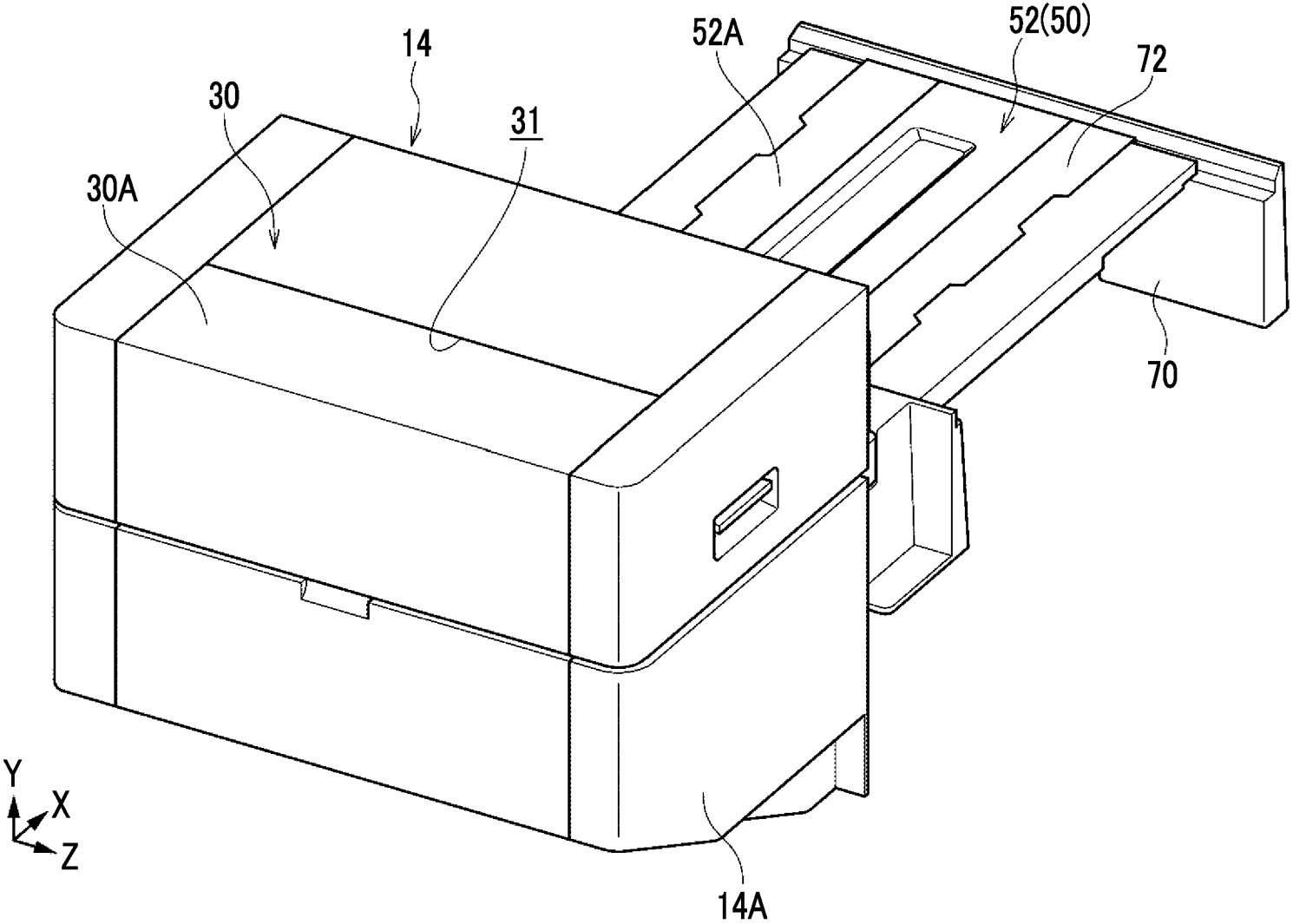
FIG. 5 is a perspective view showing the extension device of the sheet accommodating apparatus according to the first exemplary embodiment.
Figure 6:
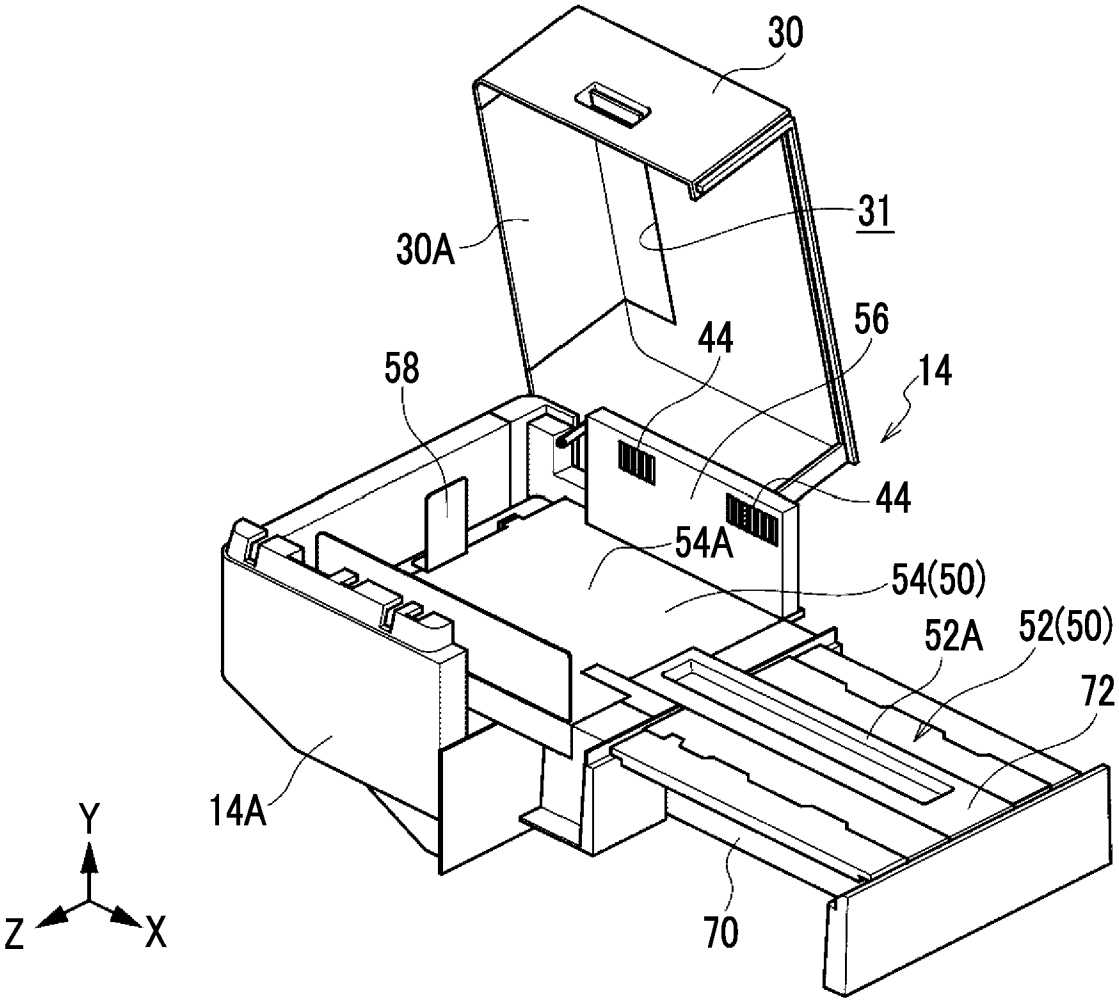
FIG. 6 is a perspective view showing the extension device of the sheet accommodating apparatus according to the first exemplary embodiment in a state where an opening and closing cover is open.

As shown in FIGS. 4 to 6, the attachment device 14 includes the first extension unit 50 that is disposed over the main body portion 14A and the main body portion 12. The first extension unit 50 is configured to extend a loading surface for the recording medium P toward a position outward of the loading portion 16 in the apparatus width direction (that is, direction along arrow X) as seen in plan view (refer to FIG. 4). The first extension unit 50 includes a raising portion 52 that raises the loading surface for the recording medium P with respect to the lowermost lowering position of the loading portion 16 inside the main body portion 12 and an extension portion 54 that extends to a position outward of the loading portion 16 from the raising portion 52 side as seen in plan view.

The raising portion 52 is disposed on the loading portion 16 inside the main body portion 12 (refer to FIG. 4). In the present exemplary embodiment, the raising portion 52 is disposed on a loading surface 16A for the recording medium P of the loading portion 16. On an upper surface of the raising portion 52, a loading surface 52A onto which the recording medium P having a long length is loaded is formed.

For example, the raising portion 52 includes a main body portion 70 attached to the loading surface 16A of the loading portion 16 and an upper wall portion 72 that is disposed above the main body portion 70 and serves as a loading surface for the recording medium P.

The extension portion 54 is attached to a side portion of the raising portion 52 and is disposed to be laid across an area from the inside of the main body portion 12 to the inside of the main body portion 14A of the attachment device 14 (refer to FIG. 4). In other words, the extension portion 54 projects to the upstream side in the transportation direction (that is, direction along arrow A) of the recording medium P from a space between the front wall 12A and the rear wall 12B. In the sheet accommodating apparatus 10, an upper portion of the side wall 12C between the front wall 12A and the rear wall 12B is open to the upstream side in the transportation direction of the recording medium P (refer to FIG. 3) and the extension portion 54 is disposed to be laid across the open portion. In the present exemplary embodiment, the apparatus width direction (that is, direction X) of the sheet accommodating apparatus 10 and the transportation direction of the recording medium P (that is, direction along arrow A) are the same as each other. On an upper surface of the extension portion 54, a loading surface 54A onto which the recording medium P having a long length is loaded is formed. The extension portion 54 is provided on one end side in a longitudinal direction (that is, length direction) of the recording medium P with respect to the raising portion 52.

The extension portion 54 is fixed to a side of the raising portion 52 by means of a fastening tool (not shown) and in a case where the loading portion 16 is lifted, the extension portion 54 is integrally lifted with the raising portion 52.

Onto the loading surface 52A of the raising portion 52 and the loading surface 54A of the extension portion 54, the recording medium P having a long length is loaded. That is, one end portion side of the recording medium P in the longitudinal direction, which is a portion of the recording medium P, is disposed on the raising portion 52 and the other end side of the recording medium P in the longitudinal direction, which is another portion of the recording medium P, is disposed on the extension portion 54. An end guide 58 that restricts an end surface on the other end side in the longitudinal direction of the recording medium P is provided at an end portion of the extension portion 54 that is on the other end side in the longitudinal direction of the recording medium P, that is, on the upstream side in the transportation direction of the recording medium P (refer to FIG. 6). The end guide 58 is formed in, for example, an L-shape and one end portion thereof is supported on an upper surface of the loading surface 54A of the extension portion 54. In the present exemplary embodiment, the end guide 58 and the extension portion 54 are formed of metal and the end guide 58 is configured to adhere to the extension portion 54 by means of a magnetic force such that the end guide 58 becomes attachable to and detachable from the extension portion 54. The end guide 58 is separated from the extension portion 54 at the time of attachment of the second extension unit 60.

A distance (distance along apparatus width direction) from one end portion on the raising portion 52 side and the other end portion on the extension portion 54 side is larger than the length of the recording medium P having a size of A3 in the longitudinal direction. In the present exemplary embodiment, the distance (distance along apparatus width direction) from the one end portion on the raising portion 52 side and the other end portion on the extension portion 54 side is set to such a distance that a terminal of the recording medium P having a length of 864 mm does not stick out. In the present exemplary embodiment, as the recording medium P having a long length that is loaded onto the raising portion 52 and the extension portion 54, for example, the recording medium P having a length larger than 488 mm and equal to or smaller than 864 mm in the longitudinal direction can be loaded.

Opposite side walls 56 of the attachment device 14 in the apparatus depth direction (that is, direction along arrow Z) are provided with a plurality of the air blowing units 44 that send air to an upper portion of the recording medium P loaded onto the extension portion 54.

Second Extension Unit

Figure 8:
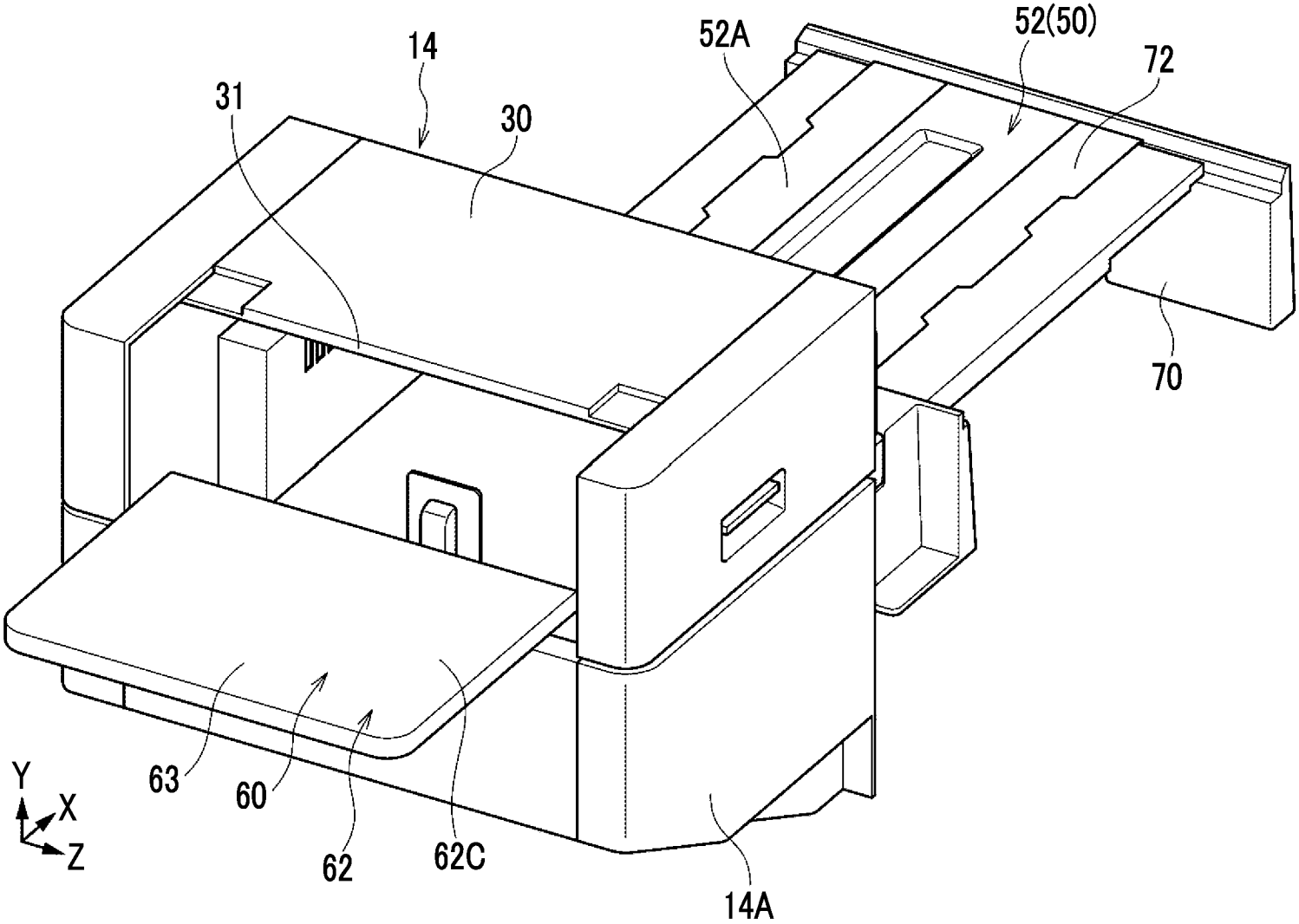
FIG. 8 is a perspective view showing the second extension unit attached to the extension device of the sheet accommodating apparatus according to the first exemplary embodiment.
Figure 9:
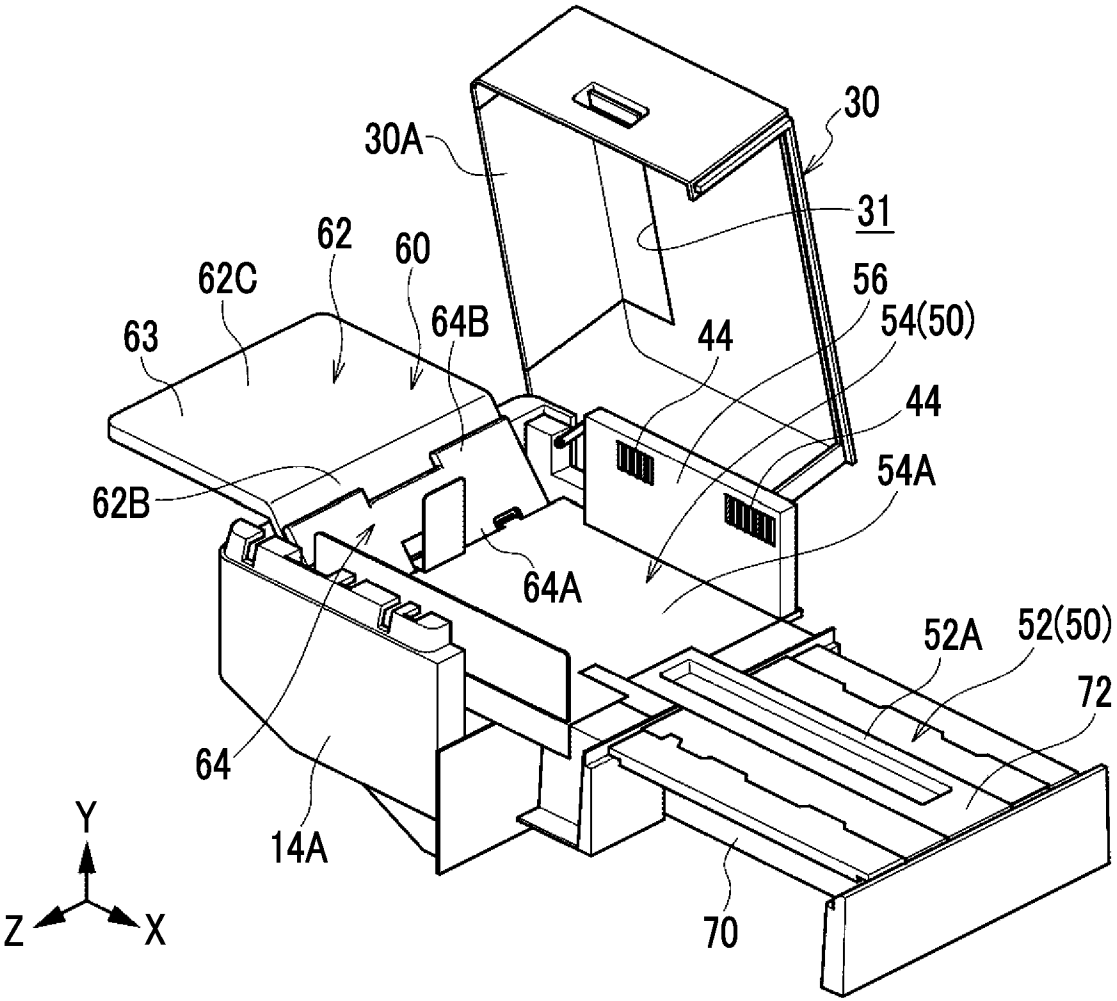
FIG. 9 is a perspective view showing the second extension unit attached to the extension device of the sheet accommodating apparatus according to the first exemplary embodiment in a state where the opening and closing cover is open.

As shown in FIGS. 4, 8, and 9, the second extension unit 60 is provided on an end portion of the main body portion 14A that is on a side opposite to the raising portion 52, that is, an end portion on the extension portion 54 side. The second extension unit 60 is provided on the one end side in the longitudinal direction of the recording medium P (that is, upstream side in transportation direction of recording medium P) with respect to the loading portion 16 of the main body portion 12. The second extension unit 60 includes a first supporting portion 62 attached to the main body portion 14A and a second supporting portion 64 that is suspended between the extension portion 54 and the first supporting portion 62 in an oblique direction. The first supporting portion 62 is connected to the main body portion 14A of the attachment device 14 attached to the main body portion 12. That is, the first supporting portion 62 is indirectly fixed to the main body portion 12 and is configured such that the first supporting portion 62 is not lifted even in a case where the loading portion 16 is lifted. The first supporting portion 62 is provided to protrude outward from the main body portion 14A. Here, the first extension unit 50 and the second extension unit 60 are an example of an extension unit.

A cutout portion 31 is formed in the opening and closing cover 30 and a corner portion cover 30A that constitutes a portion of the opening and closing cover 30 is provided at the cutout portion 31 such that the corner portion cover 30A becomes attachable to and detachable from the cutout portion 31. With the corner portion cover 30A removed, the second extension unit 60 is attached to the main body portion 14A (refer to FIG. 8).

Figure 10:
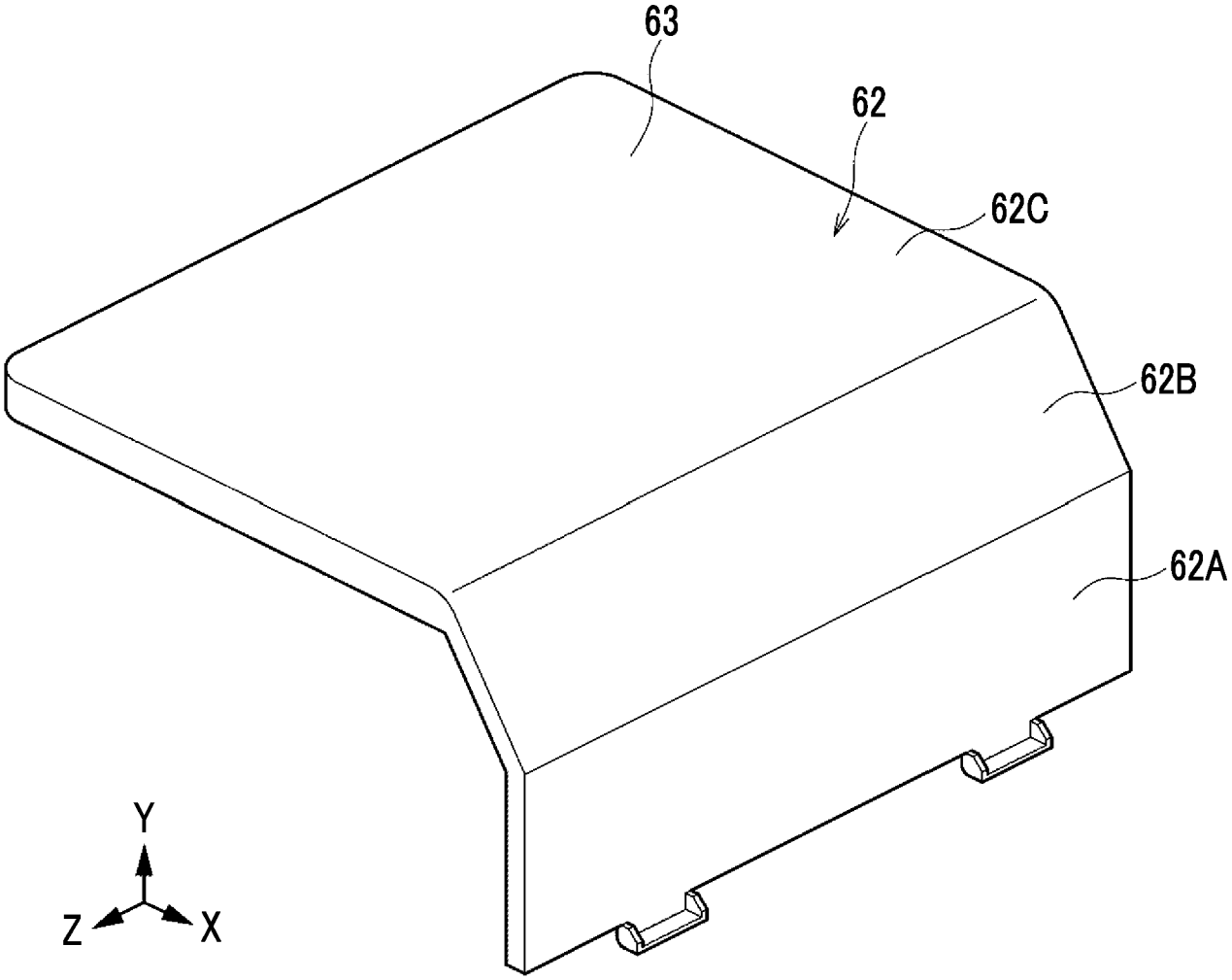
FIG. 10 is a perspective view showing a first supporting portion of the second extension unit.

The first supporting portion 62 includes a vertical wall portion 62A that is fixed to the side wall 15 of the main body portion 14A, an inclined surface portion 62B extending in an oblique direction from an upper end of the vertical wall portion 62A, and a horizontal portion 62C extending in a horizontal direction from an upper end of the inclined surface portion 62B to a side opposite to the vertical wall portion 62A (refer to FIG. 10). The inclined surface portion 62B is an example of an inclined surface. The inclined surface portion 62B extends such that a downward slope from the horizontal portion 62C is formed. On an upper surface of the horizontal portion 62C, a loading surface 63 onto which the recording medium P having a long length is loaded is provided. The height of the horizontal portion 62C is greater than the height of the extension portion 54. That is, the height of the loading surface 63 of the first supporting portion 62 is greater than the height of the loading surface 16A of the loading portion 16 in a case where the loading portion 16 is at the lowermost lowering position at which the loading portion 16 comes into contact with a frame 13 (refer to FIG. 14). For example, the first supporting portion 62 is fixed to the side wall 15 of the main body portion 14A by means of a fastening tool such as a bolt. In a state where the first supporting portion 62 is fixed to the side wall 15 of the main body portion 14A, the first supporting portion 62 is inserted into the cutout portion 31 of the opening and closing cover 30 in a closed state (refer to FIG. 8).

Figure 11:
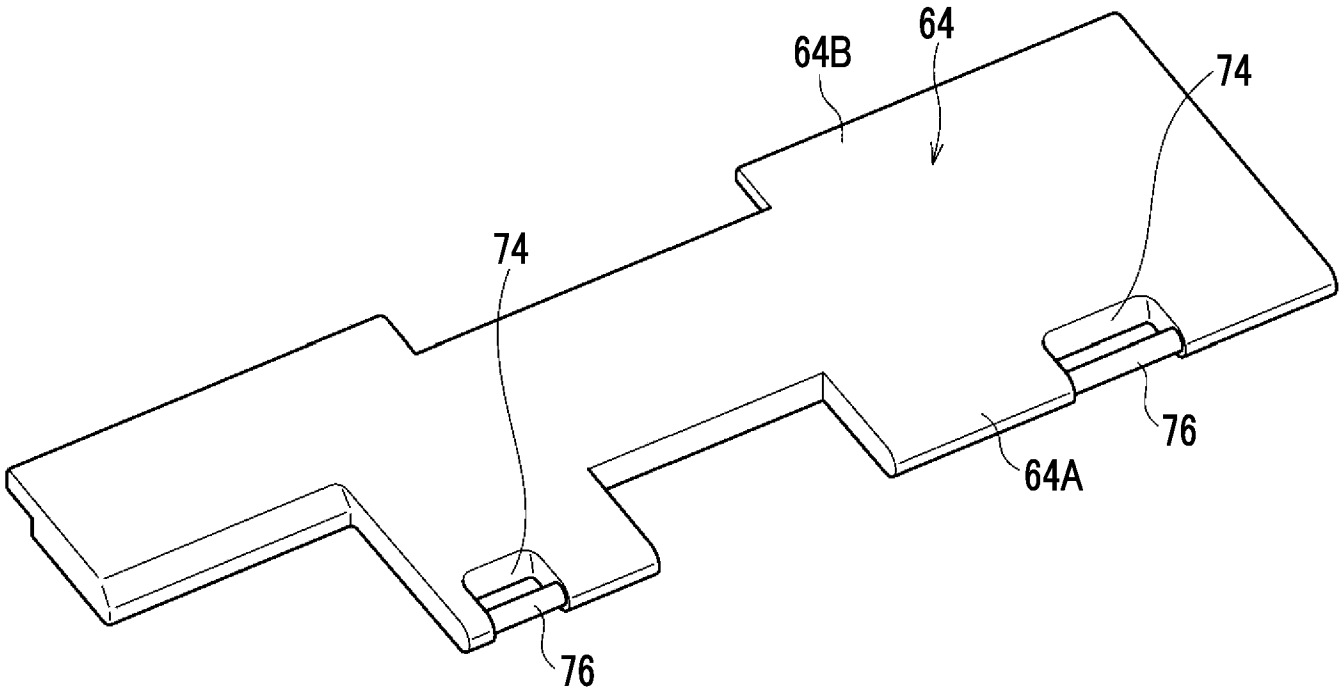
FIG. 11 is a perspective view showing a second supporting portion of the second extension unit.

Regarding the second supporting portion 64, a lower end portion 64A in the oblique direction is supported by the extension portion 54 and an upper end portion 64B in the oblique direction is in contact with the inclined surface portion 62B. The second supporting portion 64 includes cutout portions 74 obtained by cutting an edge portion of the lower end portion 64A and rods 76 suspended between opposite walls of the cutout portions 74 (refer to FIG. 11). The rods 76 are arranged in the apparatus depth direction (that is, direction Z). Two cutout portions 74 and two rods 76 are provided in a width direction of the second supporting portion 64.

Figure 7:
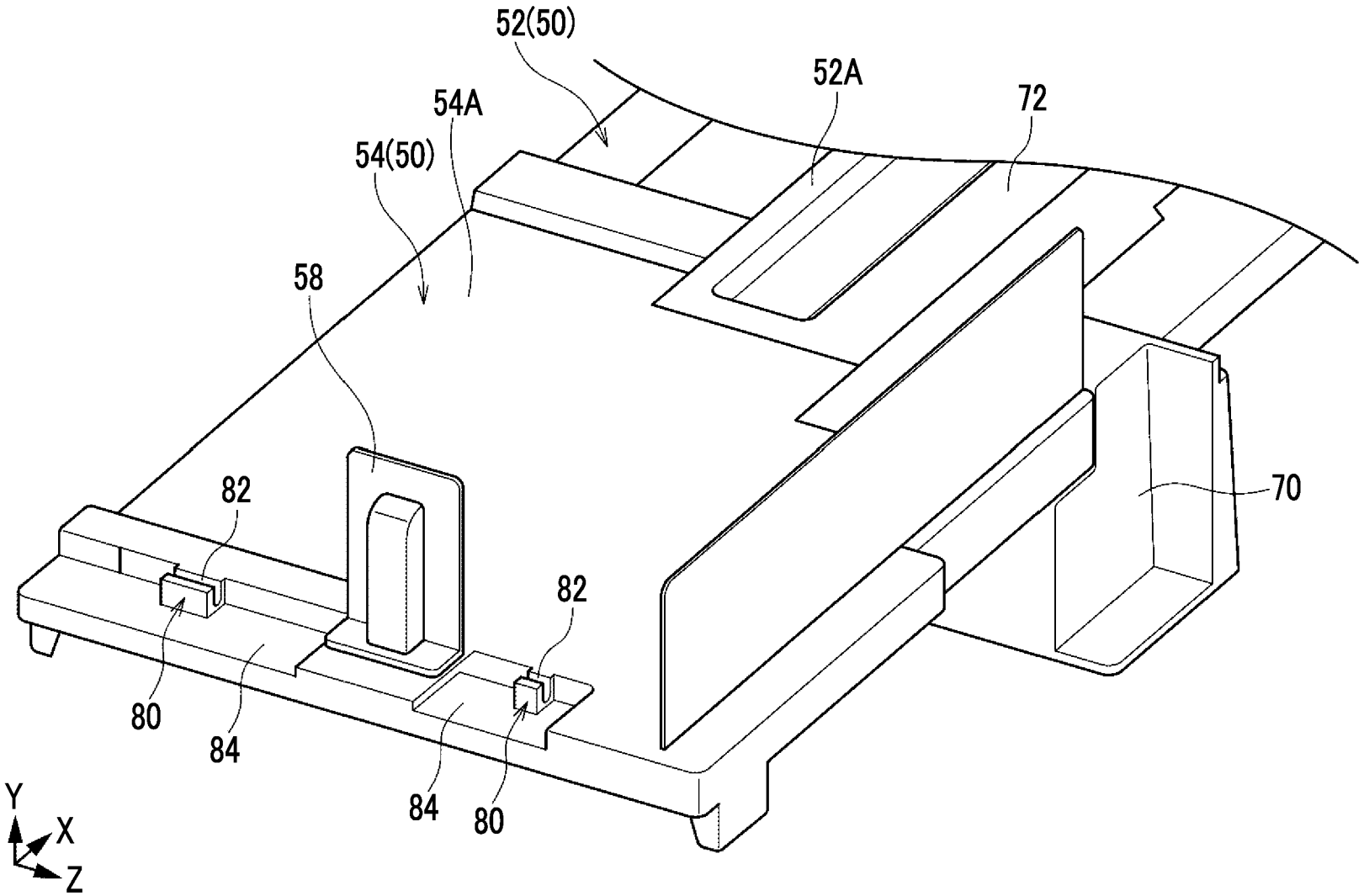
FIG. 7 is a perspective view showing a portion of a first extension unit of the sheet accommodating apparatus according to the first exemplary embodiment.

As shown in FIG. 7, the extension portion 54 is provided with supporting pieces 80 that rotatably support the rods 76. Two supporting pieces 80 are provided in the apparatus depth direction (that is, direction Z) on the extension portion 54. The supporting pieces 80 are provided with recesses 82 into which the rods 76 are inserted. In the present exemplary embodiment, the supporting pieces 80 are provided in depression portions 84 that are recessed such that the height thereof becomes smaller than the height of the loading surface 54A of the extension portion 54. Here, the loading surface 54A is an example of a bottom surface.

Figure 12:
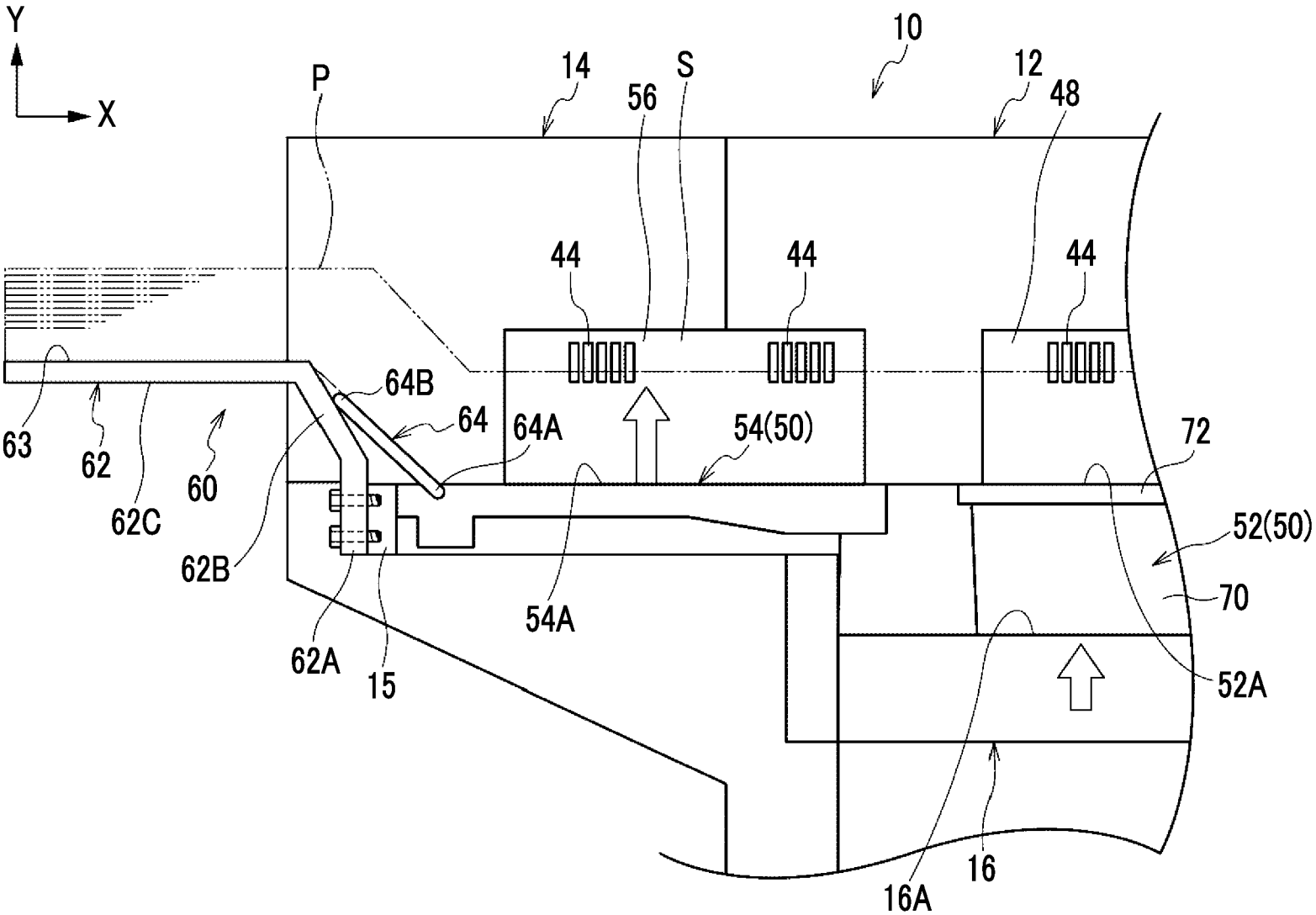
FIG. 12 is a side view showing a first state where a recording medium loaded onto the first extension unit and the second extension unit is lifted.
Figure 13:
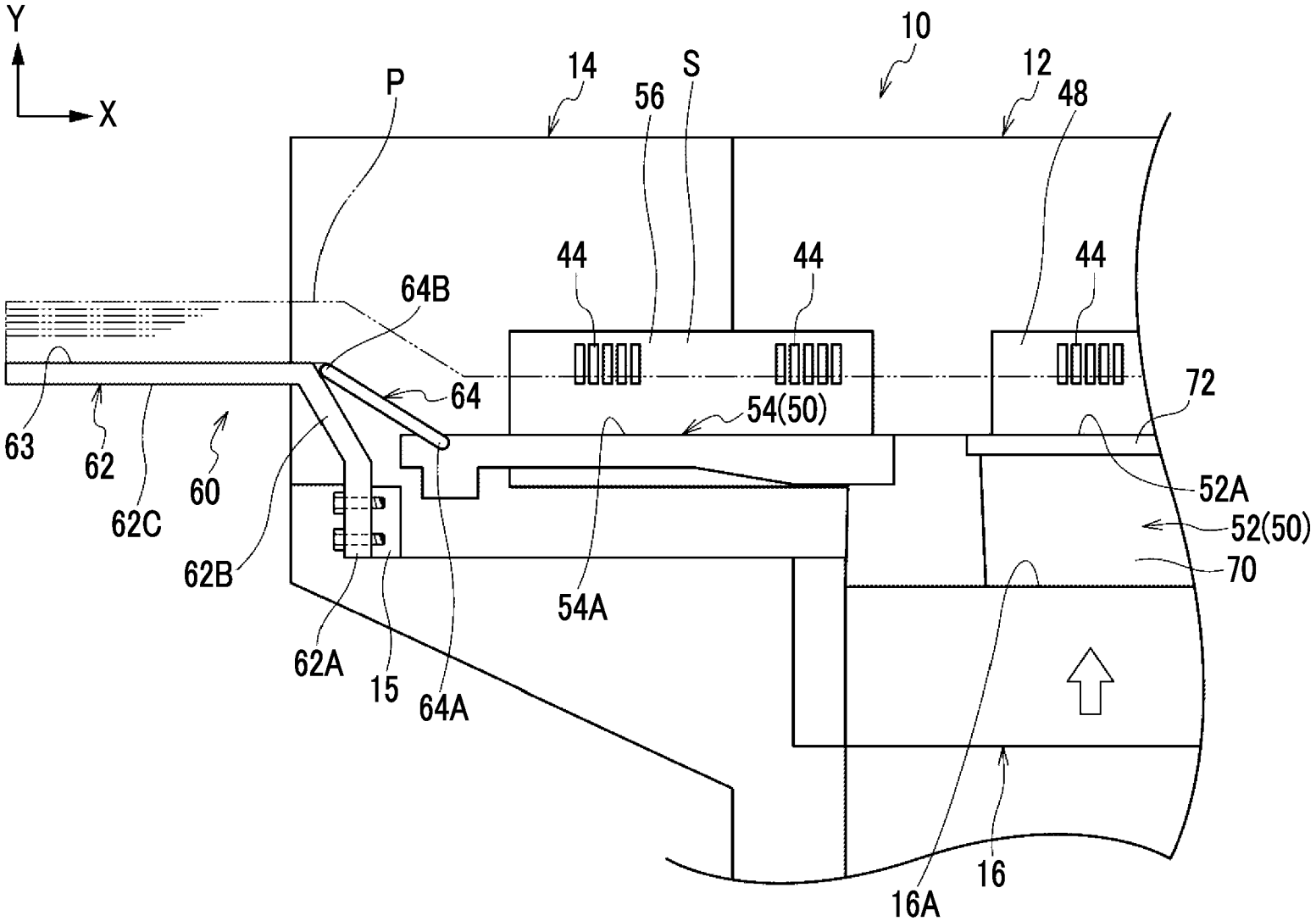
FIG. 13 is a side view showing a second state where the recording medium loaded onto the first extension unit and the second extension unit is lifted.

The second supporting portion 64 can rotate with respect to the supporting pieces 80 with the rods 76 of the second supporting portion 64 inserted into the recesses 82 of the supporting pieces 80. The upper end portion 64B of the second supporting portion 64 is in contact with the inclined surface portion 62B (refer to FIG. 12). The second supporting portion 64 is inclined such that an upward slope from the extension portion 54 on the loading portion 16 side is formed. The second supporting portion 64 can slide against the inclined surface portion 62B as the extension portion 54 is lifted (refer to FIG. 13). In addition, in a case where the loading surface 54A is further lifted in a state shown in FIG. 13, the upper end portion 64B of the second supporting portion 64 slides to the upstream side in the transportation direction of the recording medium P along the loading surface 63 of the horizontal portion 62C and the horizontal portion 62C is overlaid with the upper end portion 64B.

Onto the raising portion 52, the extension portion 54, and the second extension unit 60, the recording medium P having a long length of which the length in the longitudinal direction is larger than 864 mm and equal to or smaller than 1500 mm is loaded, for example. At this time, one end portion side of the recording medium P in the longitudinal direction is disposed on the raising portion 52 and the other end portion side of the recording medium P in the longitudinal direction is disposed over the extension portion 54, the second supporting portion 64, and the horizontal portion 62C of the first supporting portion 62. The second supporting portion 64 and the first supporting portion 62 support a portion of the recording medium P that is on the upstream side in the transportation direction from below during a process in which the lifting and lowering device 100 lifts the loading portion 16. Since the height of the horizontal portion 62C is greater than the height of the extension portion 54, the recording medium P having a long length forms a crank-shape as seen in side view as shown in FIG. 4.

As shown in FIG. 4, in the sheet accommodating apparatus 10, air is blown to a space between a plurality of the recording mediums P loaded onto the raising portion 52, the extension portion 54, and the second extension unit 60 from the air blowing units 44. Furthermore, the uppermost recording medium P is sucked by the suction unit 42 and the suction unit 42 moves toward the downstream side in the transportation direction of the recording medium P such that the recording medium P sucked by the suction unit 42 is fed by the paper feeding roller 40 in the direction along the arrow A.

Lifting and Lowering Device

Figure 14:
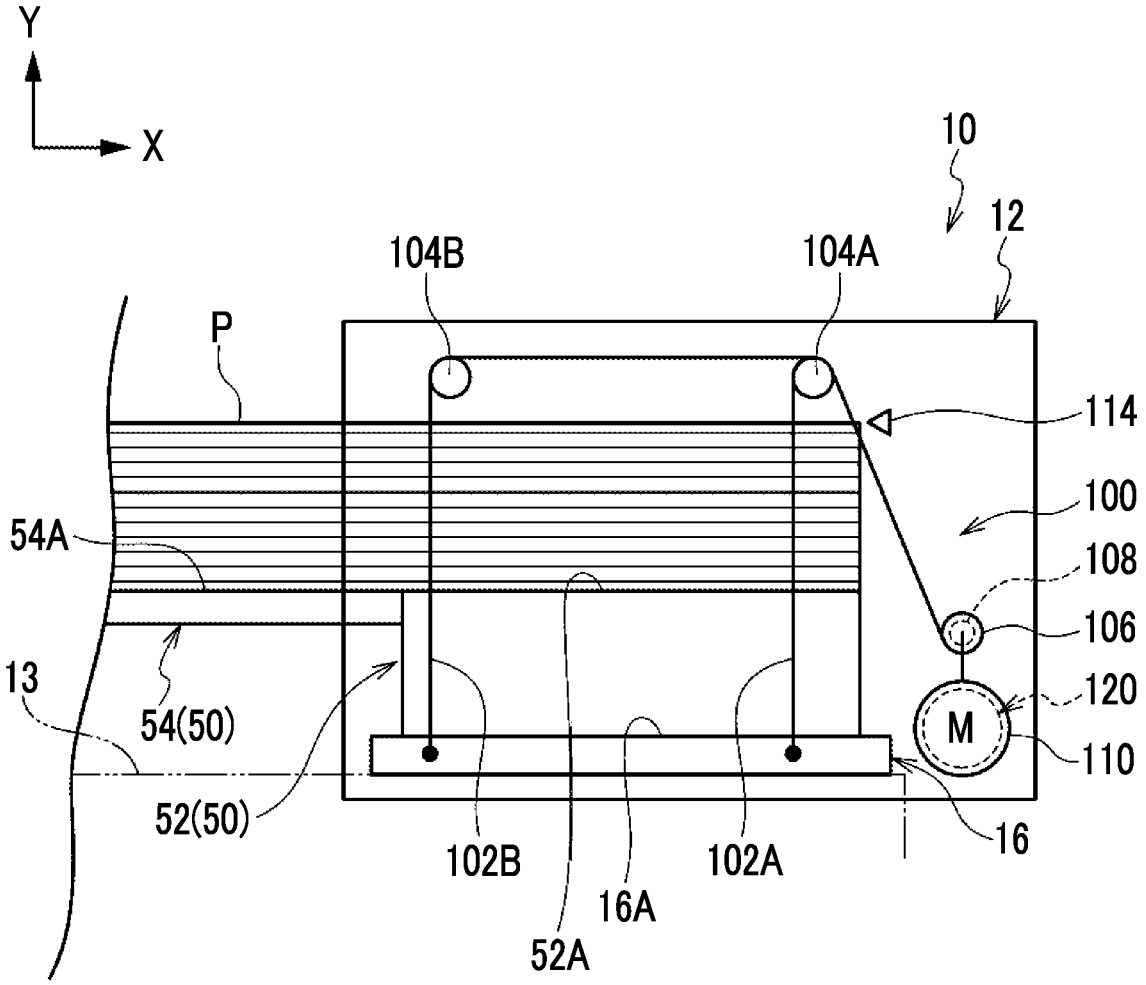
FIG. 14 is a side view showing a lifting and lowering device that lifts and lowers the loading portion for a recording medium in the sheet accommodating apparatus.
Figure 15:
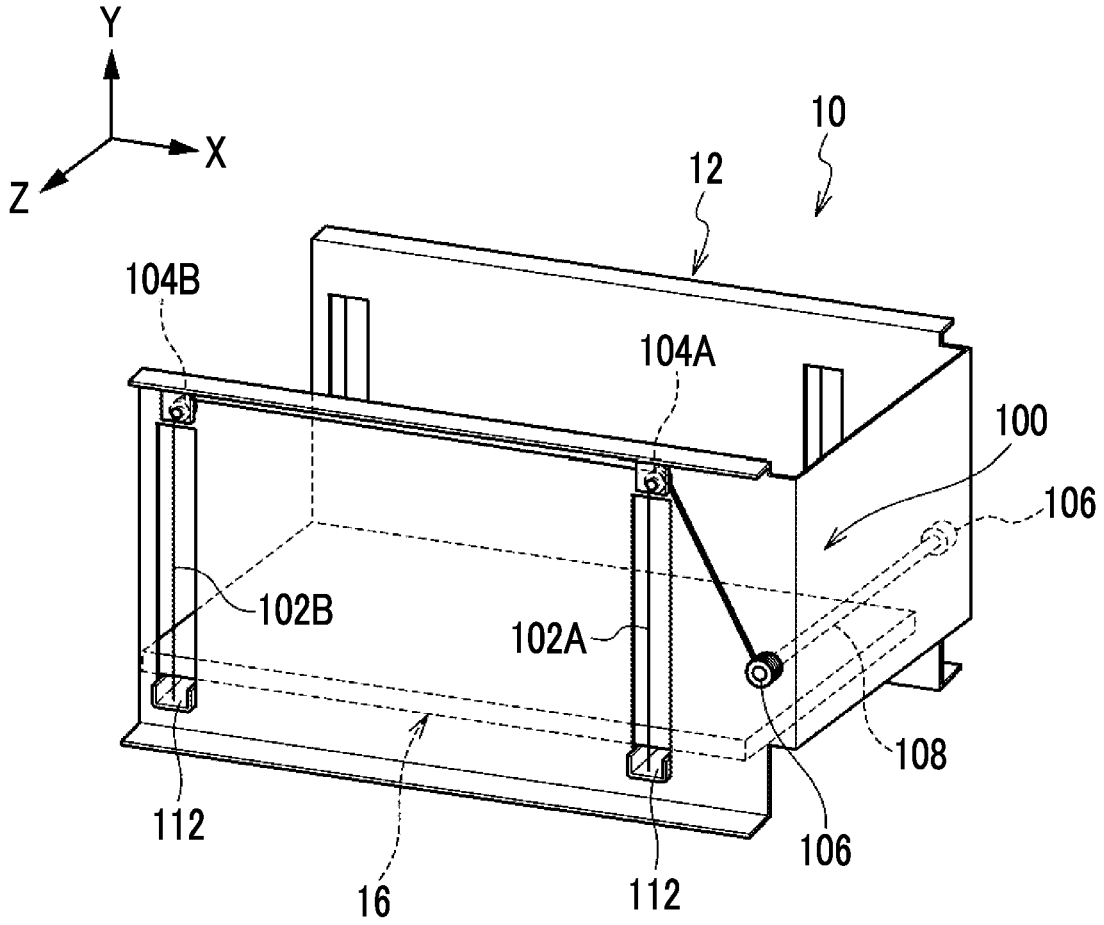
FIG. 15 is a perspective view showing the lifting and lowering device that lifts and lowers the loading portion for the recording medium in the sheet accommodating apparatus.

FIG. 14 shows a side view of the configuration of the lifting and lowering device 100. In addition, FIG. 15 shows a perspective view of the configuration of the lifting and lowering device 100. In FIG. 14, a schematic configuration is shown in order to make the configuration of the lifting and lowering device 100 easy to understand.

As shown in FIGS. 14 and 15, the lifting and lowering device 100 includes two wires 102A and 102B that are connected to a lower portion on one side in the depth direction of the loading portion 16 (in FIG. 15, front side in direction along arrow Z) and pulleys 104A and 104B that are disposed on an upper portion side of the main body portion 12 and on which the wires 102A and 102B are wound respectively. In addition, the lifting and lowering device 100 includes a winding-up pulley 106 with which the two wires 102A and 102B are wound up from the pulleys 104A and 104B (refer to FIG. 13).

Although not shown, the lifting and lowering device 100 also includes two wires 102A and 102B, the pulleys 104A and 104B, and the winding-up pulley 106 (shown in FIG. 14) on the other side in the depth direction of the loading portion 16 (in FIG. 14, rear side in direction along arrow Z). As shown in FIG. 14, the winding-up pulleys 106 on opposite sides in the apparatus depth direction are connected to each other by a pulley shaft 108. A motor 110 is connected to the winding-up pulleys 106 via a coupling mechanism 120 (refer to FIG. 15). The coupling mechanism 120 is configured to connect the winding-up pulleys 106 and the motor 110 to each other or disconnect the winding-up pulleys 106 and the motor 110 from each other.

As shown in FIG. 15, two frames 112 are attached to a lower portion of the loading portion 16 along the apparatus depth direction (direction along arrow Z) and two wires 102A and 102B are connected to the frames 112 respectively. The wire 102A is disposed on the downstream side in the transportation direction of the recording medium P on the loading portion 16 (refer to FIG. 14). The wire 102B is disposed on the upstream side in the transportation direction of the recording medium P on the loading portion 16 (refer to FIG. 14). The wire 102A is an example of a downstream side wire and the wire 102B is an example of an upstream side wire. The second extension unit 60 (refer to FIG. 4) is configured to support the recording medium P at a position upstream of the wire 102B in the transportation direction of the recording medium P.

As shown in FIG. 14, in the main body portion 12, the frame 13 that is disposed in a horizontal direction and comes into contact with the lower portion of the loading portion 16 when the loading portion 16 is lowered to the lowermost lowering position is provided. In a state where the loading portion 16 is lowered to the lowermost lowering position at which the loading portion 16 comes into contact with the frame 13, the raising portion 52 is disposed on the loading portion 16 and the extension portion 54 is attached to a side portion of the raising portion 52 that is on the upstream side in the transportation direction of the recording medium P.

As shown in FIG. 14, the lifting and lowering device 100 is provided with a sensor 114 that detects the position of the uppermost recording medium P from among recording mediums P loaded onto the loading portion 16 (in FIG. 14, onto raising portion 52 and extension portion 54). In the lifting and lowering device 100, the motor 110 is rotated based on a detection signal from the sensor 114 such that the loading portion 16 is lifted and the position of the uppermost recording medium P from among the recording mediums P reaches the predetermined height.

Operation and Effect

Next, the operation and effect of the present exemplary embodiment will be described.

In the sheet accommodating apparatus 10, in a case where the recording medium P having a long length of which the length in the longitudinal direction is longer than the length of a recording medium of a normal size (for example, recording medium P of which length is larger than 864 mm and is up to 1200 mm) is used, the attachment device 14 is attached to the main body portion 12 and the second extension unit 60 that extends the first extension unit 50 of the attachment device 14 is attached.

The first extension unit 50 includes the raising portion 52 that is disposed on the loading portion 16 and the extension portion 54 that is attached to a side portion of the raising portion 52 that is on an upper side in the vertical direction by means of a fastening tool (not shown). The first extension unit 50 is lifted as the loading portion 16 is lifted by the lifting and lowering device 100. That is, the raising portion 52 of the loading portion 16 and the extension portion 54 that is attached to the side portion of the raising portion 52 that is on the upper side in the vertical direction are integrally lifted with the loading portion 16.

The second extension unit 60 includes the first supporting portion 62 and the second supporting portion 64. The vertical wall portion 62A of the first supporting portion 62 is fixed to the side wall 15 of the main body portion 14A of the attachment device 14 via a fastening tool such as a bolt. The rods 76 of the second supporting portion 64 are inserted into the recesses 82 of the supporting pieces 80 provided on the extension portion 54 such that the upper end portion 64B of the second supporting portion 64 comes into contact with the inclined surface portion 62B.

Onto the raising portion 52, the extension portion 54, and the second extension unit 60 (that is, second supporting portion 64 and first supporting portion 62), the recording medium P having a long length is loaded (refer to FIG. 4). A portion of the recording medium P having a long length that is on the downstream side in the transportation direction is supported by the raising portion 52 and a portion of the recording medium P having the long length that is on the upstream side in the transportation direction is supported by the second extension unit 60.

Since the first supporting portion 62 is fixed to the side wall 15 of the main body portion 14A, the second extension unit 60 is not lifted even when the loading portion 16 and the first extension unit 50 are lifted by the lifting and lowering device 100. The upper end portion 64B of the second supporting portion 64 can slide against the inclined surface portion 62B as the extension portion 54 is lifted and an angle between the inclined surface portion 62B and the loading surface 54A becomes small as the extension portion 54 is lifted (refer to FIGS. 12 and 13).

The lifting and lowering device 100 lifts the loading portion 16 such that the position of the uppermost recording medium P from among the recording mediums P loaded onto the raising portion 52 reaches the predetermined height (refer to FIG. 4). In this state, in the sheet accommodating apparatus 10, the recording mediums P are supplied to the image forming apparatus 202 by the transportation unit 38 one by one.

In the sheet accommodating apparatus 10 described above, the first supporting portion 62 of the second extension unit 60 is connected to the main body portion 14A of the attachment device 14 attached to the main body portion 12. The second extension unit 60 supports a portion of the recording medium P that is on the upstream side in the transportation direction from below during a process in which the lifting and lowering device 100 lifts the loading portion 16. Therefore, in the case of the sheet accommodating apparatus 10, a load on the lifting and lowering device 100 is reduced in comparison with a configuration in which the entire mass of a sheet is applied to the loading portion.

In addition, in the sheet accommodating apparatus 10, the second extension unit 60 is provided to protrude outward from the main body portion 14A. Therefore, in the case of the sheet accommodating apparatus 10, the main body portion 12 and the main body portion 14A become compact in comparison with a case where the supporting portion is accommodated in the main body portion.

In addition, in the sheet accommodating apparatus 10, the second extension unit 60 is provided on the one end side in the longitudinal direction of the recording medium P with respect to the loading portion 16. Therefore, in the case of the sheet accommodating apparatus 10, the recording medium P having a long length other than a recording medium of a normal size is loaded in comparison with a case where a sheet is loaded onto the loading portion only.

In addition, in the sheet accommodating apparatus 10, the transportation unit 38 that transports the recording medium P loaded onto the loading portion 16 is provided and the second extension unit 60 supports a portion of the recording medium P that is on the upstream side in the transportation direction. Therefore, in the case of the sheet accommodating apparatus 10, the recording medium P is stably supported by the second extension unit 60 in comparison with a configuration in which a supporting portion supports a portion of a sheet that is on a downstream side in a transportation direction of the sheet.

In addition, in the sheet accommodating apparatus 10, the transportation unit 38 is configured to blow air to the recording mediums P loaded onto the loading portion 16 and suck the uppermost recording medium P to transport the uppermost recording medium P. Therefore, in the case of the sheet accommodating apparatus 10, multi-feeding of the recording medium P is suppressed in comparison with a case where the uppermost sheet from among sheets loaded onto the loading portion is transported only by means of the paper feeding roller.

In addition, in the sheet accommodating apparatus 10, the height of the loading surface 63 of the first supporting portion 62 of the second extension unit 60 onto which the recording medium P is loaded is greater than the height of the loading surface 16A of the loading portion 16 in a case where the loading portion 16 is at the lowermost lowering position. Therefore, in the case of the sheet accommodating apparatus 10, the mass of the recording medium P is easily supported in a case where the loading portion 16 is lifted in comparison with a case where the height of the loading surface of the supporting portion is smaller than the height of the loading surface of the loading portion.

In addition, in the sheet accommodating apparatus 10, the lifting and lowering device 100 includes the wires 102A and 102B. The second extension unit 60 supports the recording medium P at a position upstream of the wire 102B in the transportation direction of the recording medium P, the wire 102B being on the upstream side in the transportation direction of the recording medium P. Therefore, in the case of the sheet accommodating apparatus 10, the second extension unit 60 is less likely to be interfered with when the loading portion 16 and the first extension unit 50 are lifted in comparison with a case where the supporting portion supports a sheet at a position downstream of an upstream side wire in the transportation direction of the sheet.

In addition, in the sheet accommodating apparatus 10, the first supporting portion 62 of the second extension unit 60 is fixed to the main body portion 14A. Therefore, in the case of the sheet accommodating apparatus 10, a structure becomes simple in comparison with a case where the supporting portion is fixed to the loading portion.

In addition, in the sheet accommodating apparatus 10, a distance from a downstream side end portion of the loading portion 16 to an upstream side end portion of the first supporting portion 62 of the second extension unit 60 in the transportation direction of the recording medium P is greater than the length of an A3 sheet in a longitudinal direction and is smaller than 1200 mm. Therefore, in the case of the sheet accommodating apparatus 10, a sheet longer than an A3 sheet is able to be loaded.

In addition, in the sheet accommodating apparatus 10, the distance from the downstream side end portion of the loading portion 16 to the upstream side end portion of the first supporting portion 62 of the second extension unit 60 in the transportation direction of the recording medium P is set to such a distance that a terminal of the recording medium P having a length of 1200 mm does not stick out. For example, the distance is equal to or greater than 1200 mm and equal to or smaller than 1700 mm. Therefore, in the case of the sheet accommodating apparatus 10, the recording medium P having a length of 1200 mm is able to be loaded.

In addition, in the sheet accommodating apparatus 10, the second extension unit 60 includes the second supporting portion 64 that is inclined to form an upward slope from the loading portion 16 side and the horizontal portion 62C of the first supporting portion 62 that extends horizontally from an upper side of the second supporting portion 64. Therefore, in the case of the sheet accommodating apparatus 10, the recording medium P is restrained from drooping when the recording medium P is loaded in comparison with a configuration in which a space is present between the loading portion side and the horizontal portion.

In addition, in the sheet accommodating apparatus 10, the lower end portion of the second supporting portion 64 is supported such that the lower end portion becomes rotatable with respect to the extension portion 54 and the upper end portion of the second supporting portion 64 is slidable against the inclined surface portion 62B as the loading portion 16 is lifted, the inclined surface portion 62B extending from the horizontal portion 62C to form a downward slope. Therefore, in the case of the sheet accommodating apparatus 10, the recording medium P is restrained from drooping between the horizontal portion 62C and the second supporting portion 64 in comparison with a case where a lower end portion of an inclined portion is fixed to a bottom surface on the loading portion side.

In addition, in the sheet accommodating apparatus 10, the first extension unit 50 that is attached to the loading portion 16 to extend the length of the loading portion 16 is provided between the loading portion 16 and the second extension unit 60. Therefore, in the case of the sheet accommodating apparatus 10, the recording medium P having a long length is loaded in comparison with a case where the supporting portion is directly provided on the loading portion.

In addition, the image forming system 200 includes the sheet accommodating apparatus 10 and the image forming apparatus 202 that forms an image on the recording medium P transported from the sheet accommodating apparatus 10. Therefore, in the case of the image forming system. 200, a load on the lifting and lowering device 100 is reduced in comparison with a configuration in which the entire mass of a sheet is applied to a loading portion.

In addition, the second extension unit 60 is attached to the main body portion 14A of the sheet accommodating apparatus 10 and supports a portion of the recording medium P loaded onto the loading portion 16 from below during a process in which the loading portion 16 is lifted with respect to the main body portion 14A. Therefore, in the case of the second extension unit 60, a load on a lifting unit is reduced in comparison with a configuration in which the entire mass of a sheet is applied to a loading portion.

In addition, the second extension unit 60 includes the second supporting portion 64 that is inclined to form an upward slope from the loading portion 16 side and the horizontal portion 62C of the first supporting portion 62 that extends horizontally from an upper side of the second supporting portion 64. Therefore, in the case of the second extension unit 60, the recording medium P is restrained from drooping when the recording medium P is loaded in comparison with a configuration in which a space is present between the loading portion side and the horizontal portion.

In addition, the first extension unit 50 that is attached to the loading portion 16 to extend the length of the loading portion 16 is provided between the second extension unit 60 and the loading portion 16. Therefore, the recording medium P having a long length is loaded in comparison with a case where the supporting portion is directly provided on the loading portion.

Supplementary Description

In the sheet accommodating apparatus 10 according to the present exemplary embodiment, the first supporting portion 62 of the second extension unit 60 is connected to the main body portion 12 via the main body portion 14A of the attachment device 14, that is, indirectly connected to the main body portion 12. However, the present disclosure is not limited thereto. For example, a configuration in which the first supporting portion of the second extension unit is directly connected to the main body portion may also be adopted.

In the exemplary embodiment, a supporting structure of the second supporting portion 64 with respect to the extension portion 54 can be modified. For example, a configuration in which the second supporting portion is rotatably attached to the extension portion by means of a separate hinge structure may also be adopted.

In the present exemplary embodiment, the second extension unit 60 includes the first supporting portion 62 and the second supporting portion 64. However, the present disclosure is not limited thereto. For example, components of the second extension unit and the shape of the second extension unit can be modified.

In the present exemplary embodiment, the sheet accommodating apparatus 10 is provided upstream of the image forming apparatus 202 in the transportation direction of the recording medium P and the recording medium P is transported to the image forming apparatus 202 from the sheet accommodating apparatus 10. However, the present disclosure is not limited thereto. For example, a configuration in which the sheet accommodating apparatus is provided downstream of the image forming apparatus in the transportation direction of the recording medium and the recording medium on which an image has been formed by the image forming apparatus is collected by the sheet accommodating apparatus may also be adopted.

In addition, in the sheet accommodating apparatus 10, the recording medium P is used. However, the target of application of the sheet accommodating apparatus in the present disclosure is not limited to a recording medium. The sheet accommodating apparatus in the present disclosure can be applied for any sheet-shaped medium (for example, metal sheet, resin sheet, fabric sheet, or the like) other than a recording medium, for example.

Note that, although a specific exemplary embodiment of the present invention has been described in detail, the present invention is not limited to the exemplary embodiment and it is obvious to persons skilled in the art that other various exemplary embodiments are possible without departing from the scope of the present invention.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet accommodating apparatus comprising:

a main body portion;

a loading portion that is provided in the main body portion and supports a portion of a sheet loaded thereon from below;

a lifting unit that lifts the loading portion; and a supporting portion that is connected to the main body portion and supports another portion of the sheet from below during a process in which the loading portion is lifted, wherein the supporting portion includes an inclined portion that is inclined to form an upward slope from the loading portion side and a horizontal portion that extends horizontally from an upper side of the inclined portion, wherein a lower end portion of the inclined portion is supported such that the lower end portion becomes rotatable with respect to a bottom surface on the loading portion side, and wherein an upper end portion of the inclined portion is slidable against an inclined surface as the loading portion is lifted, the inclined surface extending from the horizontal portion to fonn a downward slope.

2. The sheet accommodating apparatus according to claim 1, wherein the supporting portion is provided to protrude outward from the main body portion.

3. The sheet accommodating apparatus according to claim 2, wherein the supporting portion is provided on one end side in a length direction of the sheet with respect to the loading portion.

4. The sheet accommodating apparatus according to claim 3, wherein a transportation unit that transports the sheet loaded onto the loading portion is provided, and wherein the supporting portion supports a portion of the sheet that is on an upstream side in a transportation direction of the sheet.

5. The sheet accommodating apparatus according to claim 4, wherein the transportation unit is configured to blow air to the sheet loaded onto the loading portion and suck an uppermost sheet to transport the uppermost sheet.

6. The sheet accommodating apparatus according to claim 1, wherein the supporting portion is provided on one end side in a length direction of the sheet with respect to the loading portion.

7. The sheet accommodating apparatus according to claim 6, wherein a transportation unit that transports the sheet loaded onto the loading portion is provided, and wherein the supporting portion supports a portion of the sheet that is on an upstream side in a transportation direction of the sheet.

8. The sheet accommodating apparatus according to claim 7, wherein the transportation unit is configured to blow air to the sheet loaded onto the loading portion and suck an uppermost sheet to transport the uppermost sheet.

9. The sheet accommodating apparatus according to claim 8, wherein a height of a loading surface of the supporting portion onto which the sheet is loaded is greater than a height of a loading surface of the loading portion in a case where the loading portion is at a lowermost lowering position.

10. The sheet accommodating apparatus according to claim 7, wherein the lifting unit includes an upstream side wire that is disposed on the upstream side in the transportation direction of the sheet and lifts the loading portion and a downstream side wire that is disposed on a downstream side in the transportation direction of the sheet and lifts the loading portion, and wherein the supporting portion is configured to support the sheet at a position upstream of the upstream side wire in the transportation direction of the sheet.

11. The sheet accommodating apparatus according to claim 10, wherein the supporting portion is directly or indirectly fixed to the main body portion.

12. The sheet accommodating apparatus according to claim 7, wherein a distance from a downstream side end portion of the loading portion to an upstream side end portion of the supporting portion in the transportation direction of the sheet is greater than a length of an A3 sheet in a longitudinal direction.

13. The sheet accommodating apparatus according to claim 12, wherein the distance from the downstream side end portion of the loading portion in the transportation direction of the sheet to the upstream side end portion of the supporting portion is set to such a distance that a teiiiiinal of the sheet having a length of 1200 mm does not stick out.

14. The sheet accommodating apparatus according to claim 7, wherein the uppermost sheet is sucked by a suction unit.

15. The sheet accommodating apparatus according to claim 1, wherein an extension loading portion that is attached to the loading portion to extend a length of the loading portion is provided between the loading portion and the supporting portion.

16. An image foiining system comprising:

the sheet accommodating apparatus according to claim 1 that includes a transportation unit; and an image forming apparatus that forms an image on the sheet transported from the sheet accommodating apparatus.

17. An extension unit comprising:

a supporting portion that is attached to a main body portion of a sheet accommodating apparatus and supports a portion of a sheet loaded onto a loading portion from below during a process in which the loading portion provided in the main body portion is lifted with respect to the main body portion, wherein the supporting portion includes an inclined portion that is inclined to form an upward slope from the loading portion side and a horizontal portion that extends horizontally from an upper side of the inclined portion, wherein a lower end portion of the inclined portion is supported such that the lower end portion becomes rotatable with respect to a bottom surface on the loading portion side, and wherein an upper end portion of the inclined portion is slidable against an inclined surface as the loading portion is lifted, the inclined surface extending from the horizontal portion to form a downward slope.

18. The extension unit according to claim 17, further comprising:

an extension loading portion that is attached to the loading portion to extend a length of the loading portion.

* * * * *